United States Patent [19]

Campbell

[11] 4,342,563

[45] Aug. 3, 1982

[54] BOX ASSEMBLY SYSTEM

[75] Inventor: Frederick R. Campbell, Cloverdale, Calif.

[73] Assignee: Crown Zellerbach Corporation, San Francisco, Calif.

[21] Appl. No.: 172,884

[22] Filed: Jul. 28, 1980

[51] Int. Cl.[3] ..... B31B 1/46

[52] U.S. Cl. ..... 493/168; 493/174

[58] Field of Search ..... 493/89, 183, 168, 174, 493/162, 176, 175, 183, 901

[56] References Cited

U.S. PATENT DOCUMENTS

| | | | |
|---|---|---|---|
| 3,975,994 | 8/1976 | Nakane | 493/168 X |
| 3,978,774 | 9/1976 | Royal | 493/168 |
| 4,174,658 | 11/1979 | Graham | 493/168 |

*Primary Examiner*—James F. Coan

*Attorney, Agent, or Firm*—Thomas R. Lampe

[57] ABSTRACT

An apparatus and method for forming a box having a box body comprising interconnected bottom, side and end walls, shoulder elements connected to the side walls and securing flaps connected to the shoulder elements.

3 Claims, 13 Drawing Figures

BOX ASSEMBLY SYSTEM

BACKGROUND OF THE INVENTION

A commonly used container for the packing and shipping of produce is a lug-like box formed of corrugated material or the like having a box body defined by bottom, side and end walls and shoulder elements partially covering the top of the box, said shoulder elements being secured in position by securing flaps glued or otherwise secured to the end walls of the box body. While suitable machines have been devised for assembling the box body component of the box comprising the bottom, side and end walls, final assembly of the box through the manipulation of the shoulder elements and securing flaps and the securing thereof in position has been a separate and often manual operation at another location. Obviously, this has greatly added to the cost of the fully assembled boxes.

It is therefore an object of the present invention to provide apparatus which is simple and economical in its construction which eliminates the need for separate final assembly of boxes of the aforedescribed type.

It is a further object of the present invention to provide an improved method of assembly of such boxes.

SUMMARY OF THE INVENTION

According to the present invention a box body comprising interconnected bottom, side and end walls is advanced to a final box assembly station from a box body assembly machine whereat shoulder elements connected to the side walls are bent relative thereto so that the shoulder elements define a box interior with the bottom, side and end walls. After the shoulder elements have been so positioned, securing flap positioning means bends securing flaps attached to the shoulder elements and places the securing flaps into engagement with the box body end walls. The aforesaid operations tend to urge the box body out of the final assembly station and holding means is provided for positively restraining the box body against motion during bending of the shoulder elements and the securing flaps.

Other objects and characteristics of the invention will be apparent from the following more detailed description and accompanying drawings in which:

DETAILED DESCRIPTION

Figure 1:
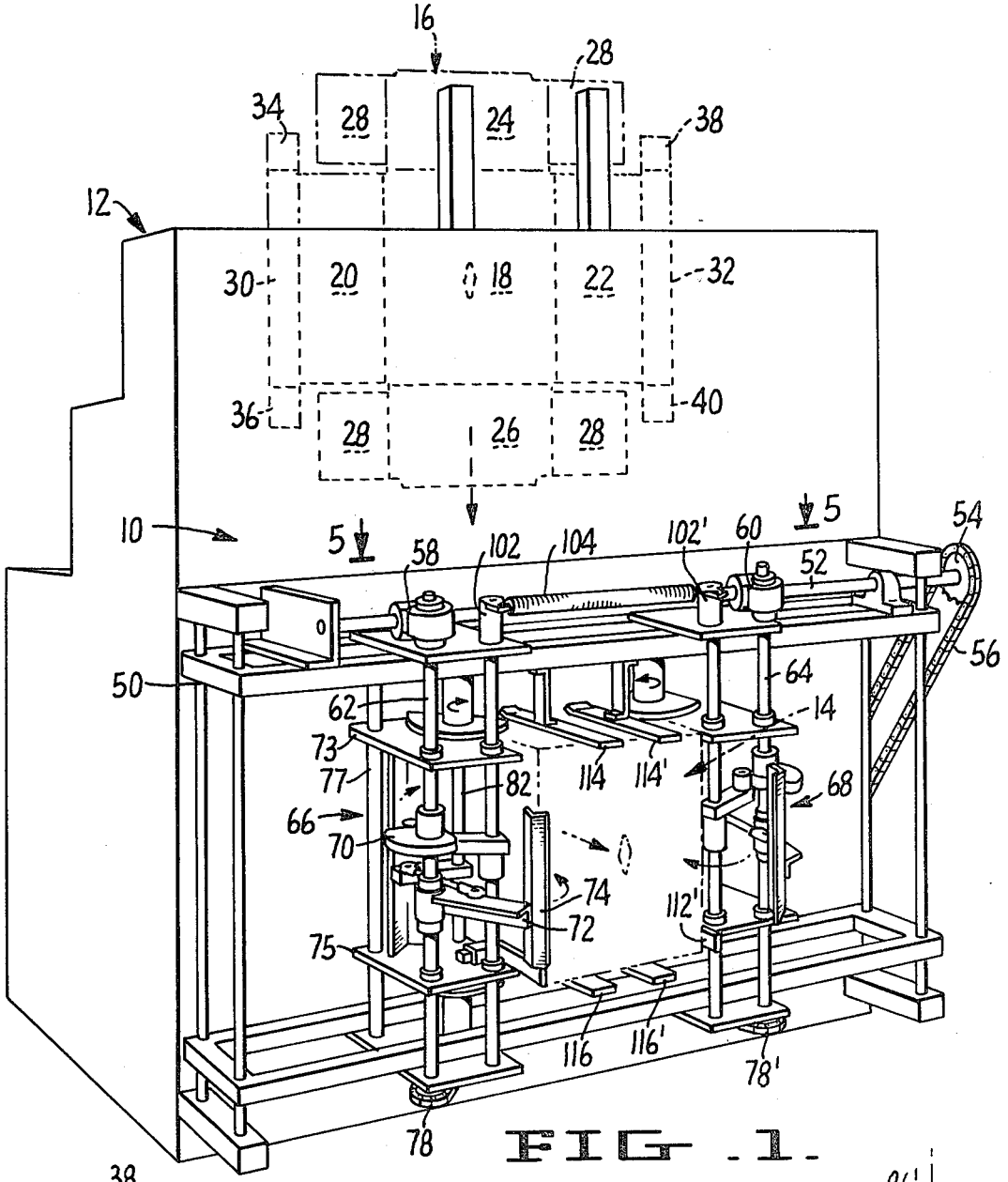
FIG. 1 is an isometric view of apparatus constructed in accordance with the teachings of the present invention.

Referring now to FIG. 1, apparatus constructed in accordance with the teachings of the present invention is generally indicated by reference numeral 10. Apparatus 10 is positioned at the discharge end of any suitable machine 12 which is adapted to deliver a partially assembled box 14 to apparatus 10. More specifically, assembly machine 12 is adapted to receive a unitary blank 16 and convert it to a partially assembled box. Blank 16 includeds a bottom wall panel 18, side wall panels 20 and 22, and end wall panels 24 and 26 which are manipulated by suitable mechanism (not shown) in assembly machine 12 and secured together by means of glue flaps 28 to form an integral box body comprising a bottom, side and end walls. It will be appreciated that many suitable assembly machines for completing the aforesaid described partial or box body assembly are in existence and the specific approach for accomplishing this forms no part of the present invention which is concerned with the final assembly of the lug-like box 14 in a manner to be described below. One suitable assembly machine 12 that may be utilized in conjunction with apparatus 10 is the Model F.P.M. Co. ATM-X automatic tray maker manufactured by Future Packaging Machinery Co., Fresno, Calif.

Figure 2:
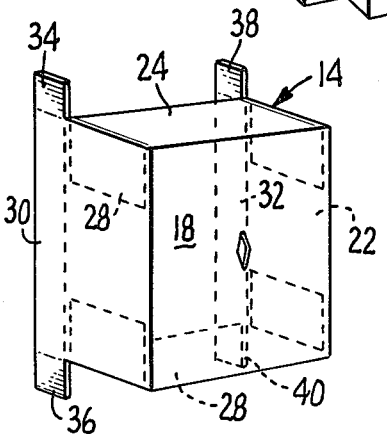
FIGS. 2, 3 and 4 are schematic illustrations of a container in the sequential stages of final assembly thereof.

FIG. 2 illustrates the condition of a box 14 after it is delivered by assembly machine 12 to apparatus 10. In addition to the assembled box body comprising the bottom, side and end walls, partially assembled box 14 includes two shoulder elements 30 and 32 hingedly connected to side walls 20 and 22 and securing flaps 34, 36, 38 and 40 integrally connected to the shoulder elements at the ends thereof as shown. Preferably, the securing flaps are connected to their associated shoulder elements along hinge lines. Likewise, the shoulder elements are preferably connected along their respective associated side walls by hinge lines to facilitate bending thereof.

Figure 3:
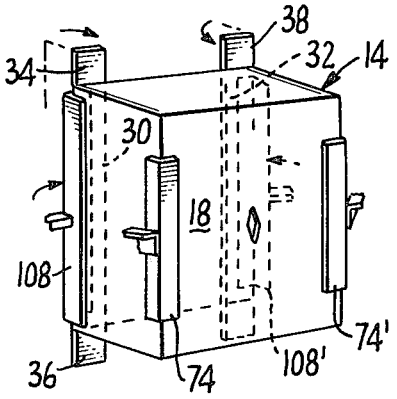
Figure 4:
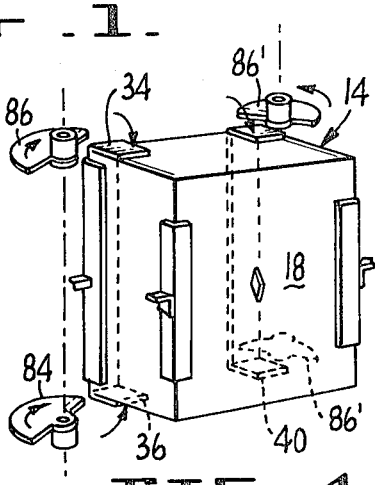

FIGS. 3 and 4 illustrate box 14 being taken through the stages of final box assembly. In FIG. 3 the shoulder elements 30 and 32 are shown being bent relative to their respective attached side walls inwardly toward one another so that the shoulder elements define a box interior with the bottom, side and end walls. The mechanism employed in apparatus 10 for accomplishing this end will be described below. The next step in final box assembly is shown in FIG. 4 wherein the securing flaps attached to the shoulder elements are bent relative thereto and placed into engagement with the container end walls. It will be understood that by any suitable mechanism such as glue applicator jets (not shown) glue has previously been applied to either the securing flaps or the locations on the end walls to which the securing flaps are brought into engagement to fixedly adhere the securing flaps to the end walls. The finally assembled box 14 illustrated in FIG. 4 thus has a lug-like configuration with a partially open top defined by the end walls and the shoulder elements and is particularly suitable for the packing and shipping of produce or the like.

Figure 13:
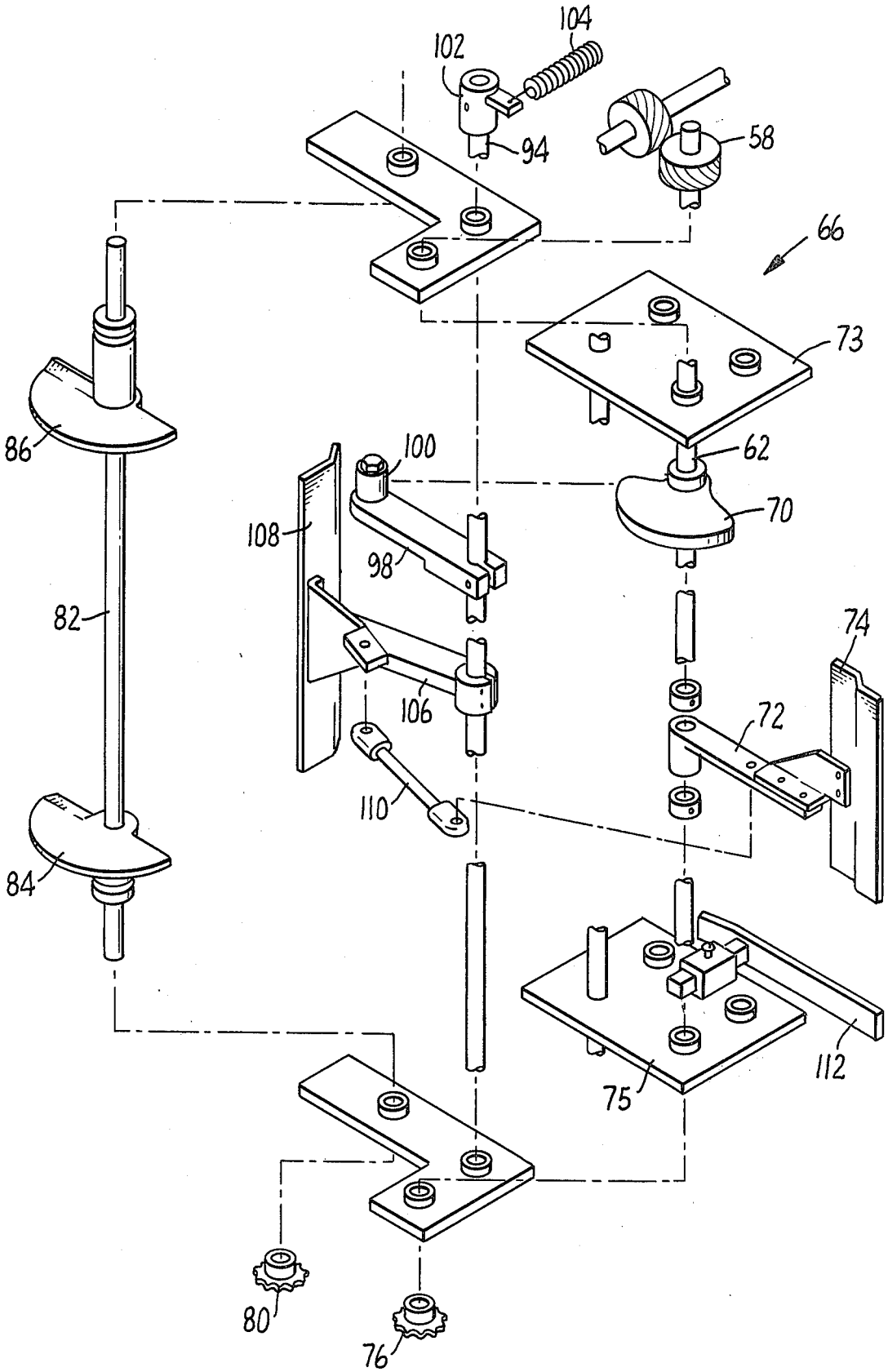
FIG. 13 is an exploded view illustrating certain operational components of the appartus constructed in accordance with the teachings of the present invention.

The construction and operation of apparatus 10 for completing the aforedescribed final assembly of box 14 will now be described. Apparatus 10 includes a framework 50 attached to the discharge end of assembly machine 12. A drive shaft 52 is rotatably mounted on the top of framework 50. A sprocket 54 is disposed at the end of drive shaft 52 and is connected by a drive chain 56 to suitable prime mover means (not shown) associated with assembly machine 12 so that the operation of apparatus 10 coordinates with that of the assembly machine. Drive shaft 52 passes through gear boxes 58 and 60 which transmit the rotational motion of drive shaft 52 to auxiliary drive shafts 62 and 64 extending vertically within framework 50 and mounted for rotational movement with respect thereto. The auxiliary drive shafts 62 and 64 respectively operate apparatus subassemblies 66 and 68 which perform the aforedescribed final assembly steps relating to the shoulder elements and securing flaps on the left and right hand sides, respectively, of box 14. It will be appreciated that subassemblies 66 and 68 are essentially mirror images of one another and for purposes of simplicity detailed description will be presented of only subassembly 66 which is illustrated in the exploded view of FIG. 13. Corresponding parts in subassembly 68 will be identified with the reference numbers used with respect to subassembly 66 parts but will bear a prime (') designation.

Fixedly attached to auxiliary drive shaft 62 is a cam member 70. Disposed below cam member 70 and maintained a predetermined distance therefrom along shaft 62 by means of lock collars is an arm 72 which is rotatably mounted upon shaft 62. A holding plate 74 is affixed to the outer extremity of arm 72 in the manner illustrated. Fixedly attached to the bottom of auxiliary drive shaft 62 is a drive sprocket 76 which is interconnected by means of drive chain 78 to a driven sprocket 80 fixedly attached to the lowermost end of a second upstanding rotatable shaft 82. Spaced semicircular plate members 84 and 86 are fixedly attached to shaft 82 for rotation therewith.

Figure 5:
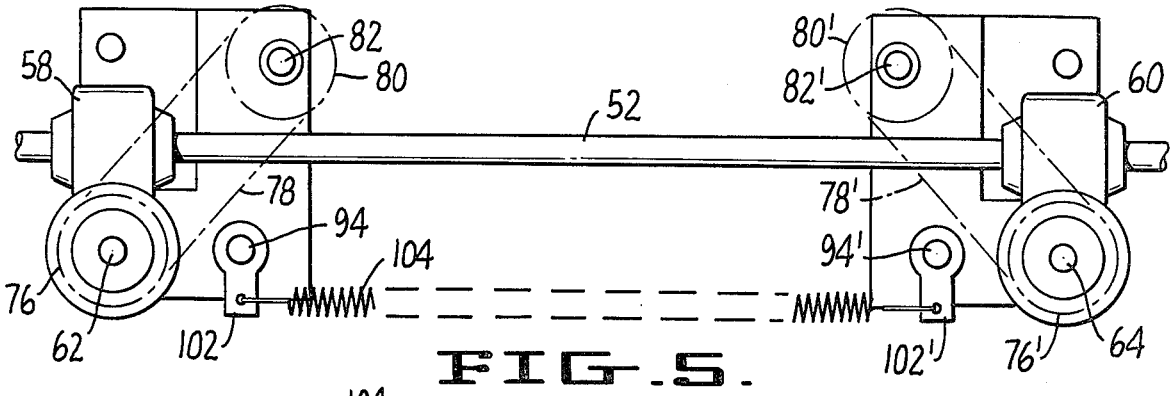
FIG. 5 is an enlarged partial view taken along the line 5—5 in FIG. 1.
Figure 6:
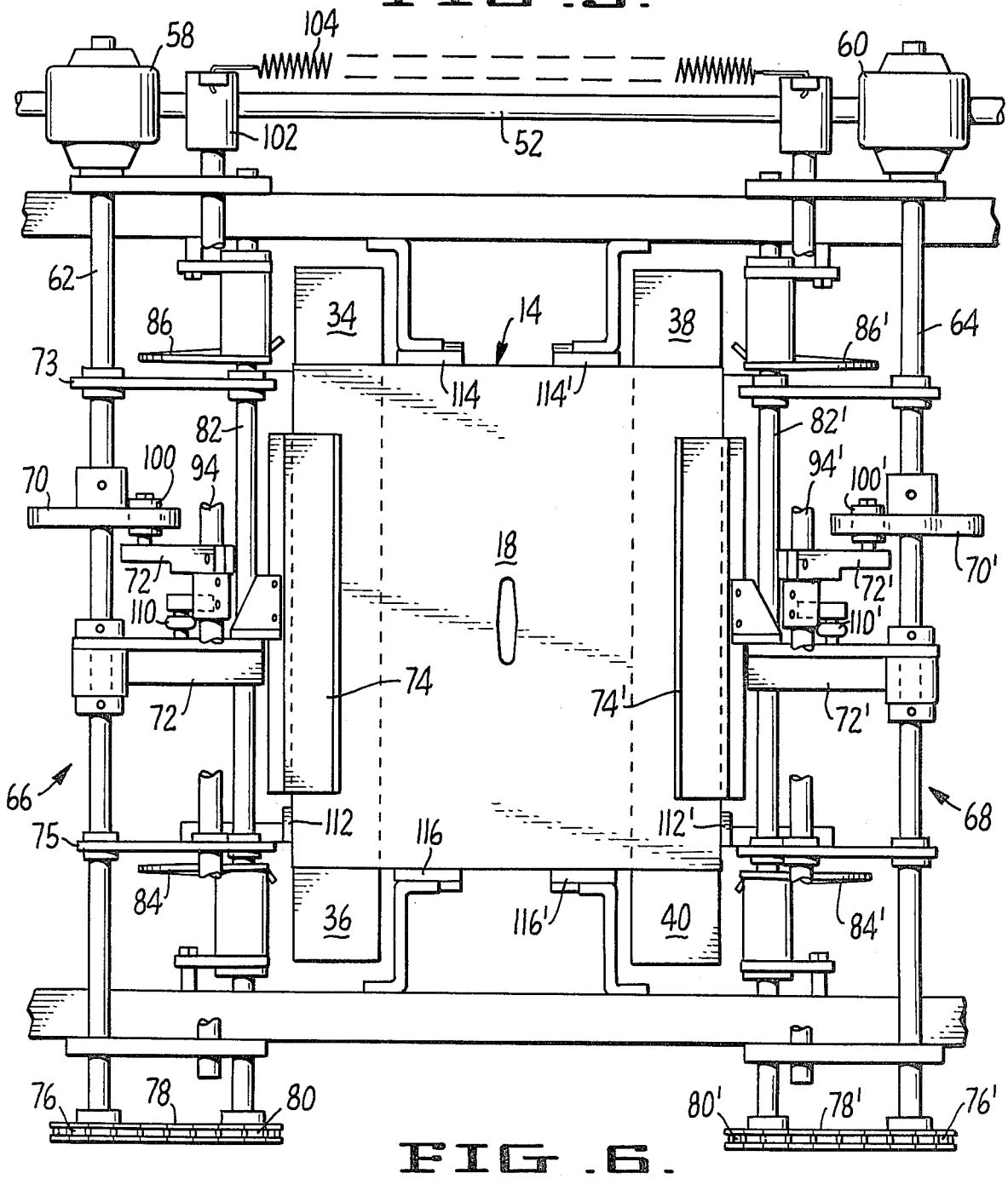
FIG. 6 is an enlarged elevational view of the portion of the apparatus as seen in FIG. 5.

A third vertically disposed rotatable shaft 94 is mounted in framework 50. A crank arm 98 is fixedly attached to shaft 94, said crank arm having a cam follower 100 mounted on the outer extremity thereof. At the upper extremity of shaft 94 is a connector element 102. A coil spring 104 under constant tension extends between connector element 102 and a corresponding connector element 102' comprising a portion of apparatus subassembly 68. It will be appreciated that coil spring 104 continuously urges connector element 102 and hence shaft 94 in a counterclockwise direction as viewed in FIG. 5. This results in the continuous urging of cam follower 100 into engagement with cam member 70. Thus, rotation of cam member 70 will result in reciprocal movement of shaft 94.

Disposed below crank arm 98 and fixedly attached to shaft 94 is a connector arm 106 having a shoulder element folder plate 108 attached to the outer extremity thereof. A link member 110 provides an interconnection between connector arm 106 and arm 72. Thus, reciprocal movement of connector arm 106 will result in corresponding reciprocal movement of arm 72 and holding plate 74 about auxiliary drive shaft 62. Subassembly 66 is preferably stabilized by incorporating therein mounting plates 73 and 75 through which shafts 62, 82 and 94 are disposed. Plates 73 and 75 are connected by bar 77 to maintain a predetermined distance therebetween.

Figure 7:
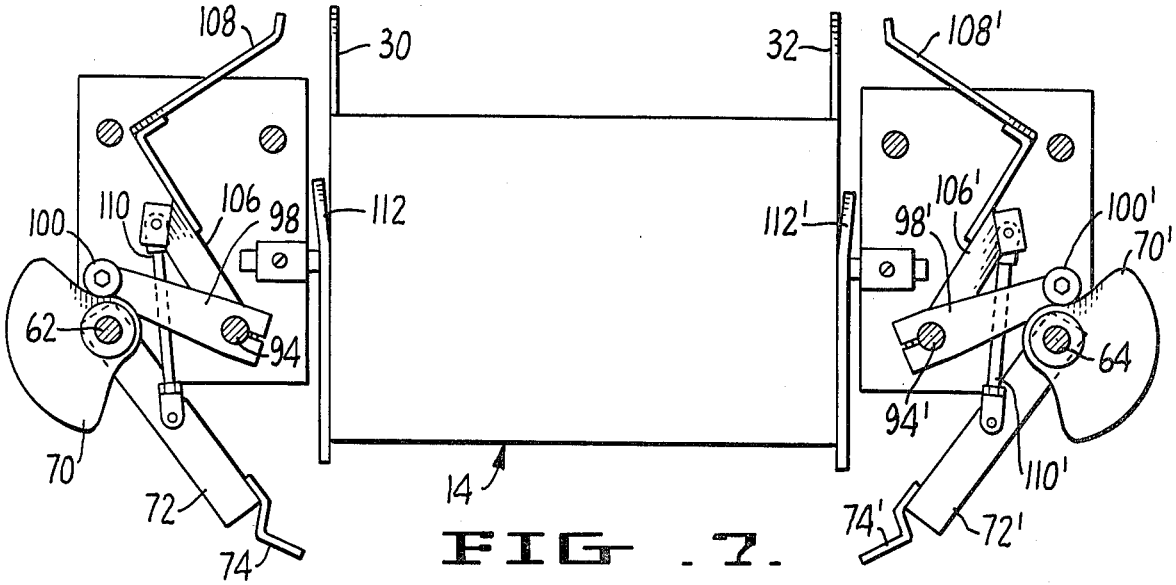
FIG. 7 is an enlarged plan view illustrating certain operational components of the apparatus in the relative positions assumed thereby prior to bending of the shoulder elements of a container.
Figure 8:
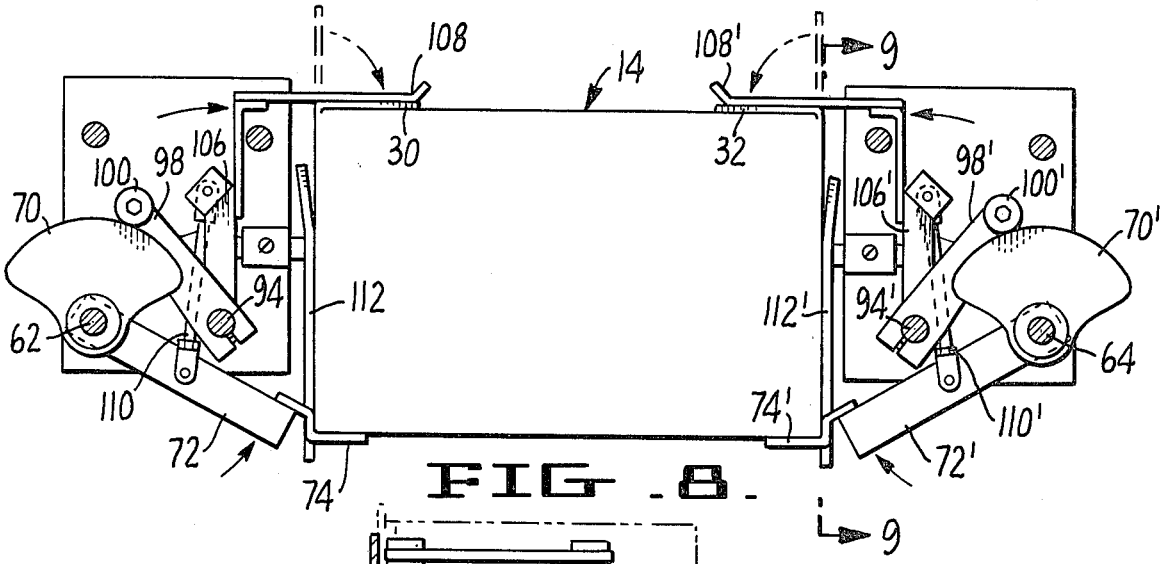
FIG. 8 is a view similar to that of FIG. 7 but illustrating the relative positions assumed by the selected operational components of the apparatus after the shoulder elements of the container have been bent to define a box interior with the box body.
Figure 9:
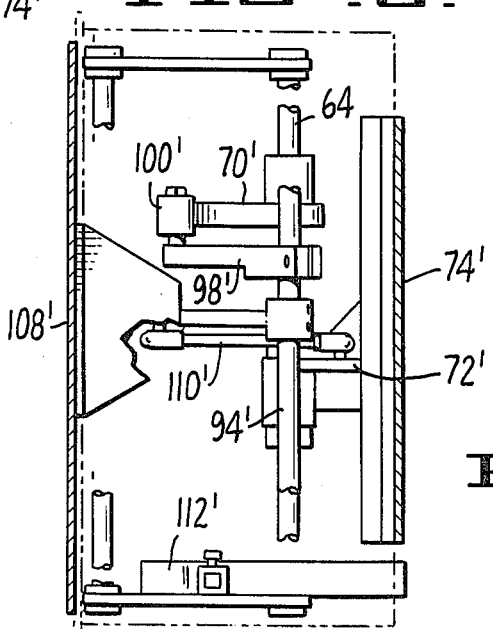
FIG. 9 is a sectional view taken along lines 9—9 of FIG. 8.

Operation of the apparatus 10 will now be described. It will be assumed that a box 14 in the partially assembled condition illustrated in FIG. 2 has been received by apparatus 10 from assembly machine 12 and occupies the position illustrated in FIG. 1. In such position the side walls of box 14 will be received by and engaged between selectively adjustable horizontal skid bars 112 and 112' extending from plates 75, 75' and comprising portions of apparatus subassemblies 66 and 68, respectively. The box end walls will be received by and positioned between a set of upper skid bars 114, 114' and 116, 116', said skid bars being attached to framework 50 by any suitable means. As may perhaps best be seen with reference to FIGS. 7 and 8, rotation of cams 70, 70' will cause folder plates 108, 108' to engage shoulder elements 30 and 32 and bend them inwardly toward each other along the hinge lines connecting the shoulder elements to their respective box side walls. Substantially simultaneously with such movement, the linkage of connector links 110, 110' will cause movement of holding plates 74, 74' from the positions shown in FIG. 7 to the positions illustrated in FIG. 8. It will be noted that holding plates 74, 74' will thus function as stop members to prevent movement of the box body as a result of pressure being applied to the shoulder elements by folder plates 108, 108'.

Figure 12:
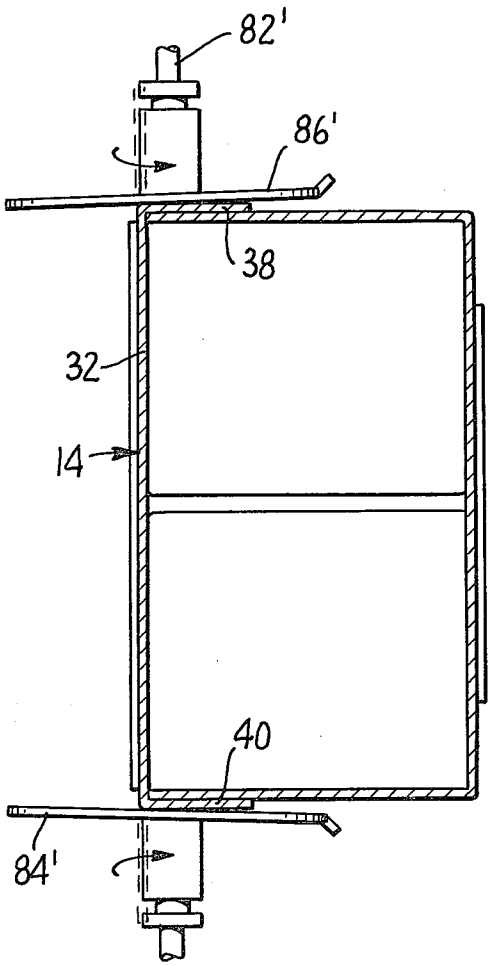
FIG. 12 is an enlarged side view in partial cross section illustrating the positioning of the box securing flaps against the end walls thereof.
Figure 10:
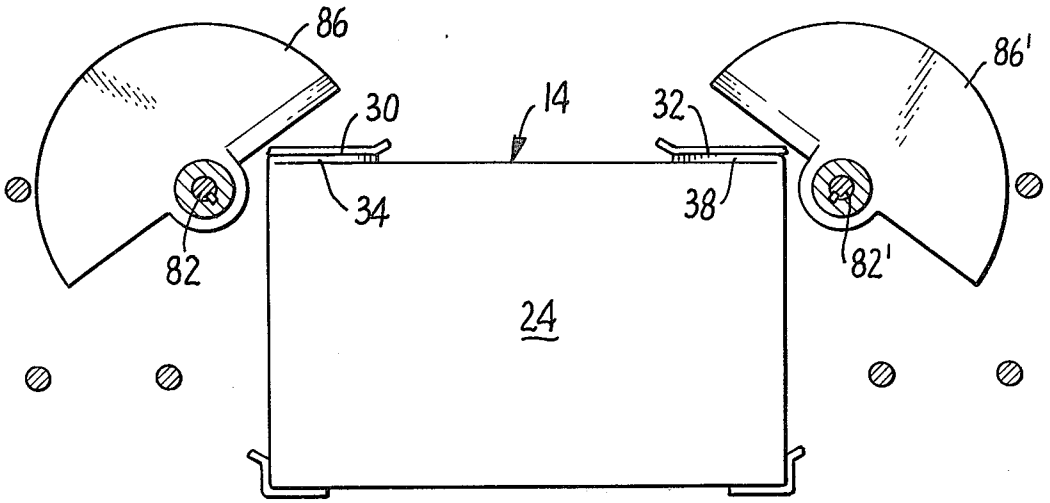
FIG. 10 is an enlarged plan view illustrating the relative positions assumed between a container and preselected operational components of the apparatus just prior to the securing flaps of the container being bent into engagement with a container end wall.
Figure 11:
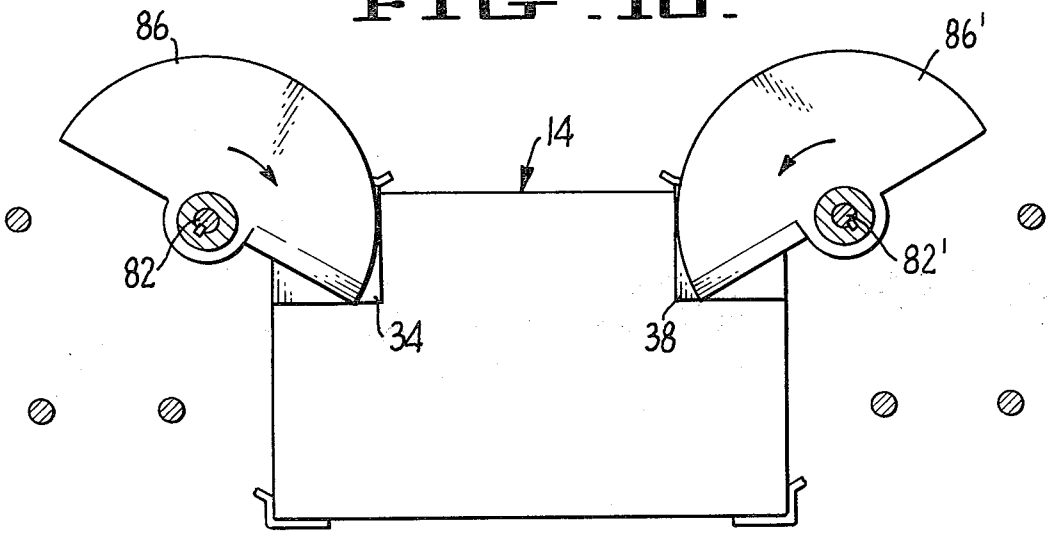
FIG. 11 is a view similar to that of FIG. 10 but illustrating the relative positions assumed by selected operational components of the apparatus and the box when the securing flaps are being urged into position against a container end wall.

During the aforesaid operation shafts 82, 82' will also be continuously rotating. After shoulder elements 30 and 32 have been moved to the locations illustrated in FIG. 10 the semicircular plate members 84, 84' and 86, 86' will engage the box securing flaps, bending the flaps relative to their associated shoulder elements and placing the securing flaps into engagement with the box end walls. Through a suitable mechanism (not shown) adhesive will have been previously applied to either the securing flaps or the portions of the end walls with which the securing flaps are bought into engagement so that the securing flaps are affixed to the end walls. As may perhaps be best seen with reference to FIG. 12 the semicircular plate members are disposed at an angle on shafts 82, 82'. Thus, the plate members operate as cam elements and during rotation thereof in engagement with the securing flaps progressively increase the pressure between the securing flaps and the box end walls.

After assembly of box 14 is completed continued rotation of drive shaft 52 will cause disengagement of holding plates 74, 74' folder plates 108, 108' and plate members 84, 84', 86, 86' from the completed box. It will be understood of course that the foregoing operation is part of a continuous process and the completed box 14 will be displaced from the operating position shown in FIG. 1 by a subsequent partially assembled box fed from assembly machine 12.

I claim:

1. In an apparatus for forming a box having a box body comprising interconnected bottom, side and end walls, shoulder elements connected to said side walls and securing flaps connected to said shoulder elements, the improvement comprising:

means for receiving said box body, said receiving means including a framework and skid means attached to said framework engageable with a plurality of said walls and defining a passageway for said box;

shoulder element positioning means adjacent to said skid means adapted to bend said shoulder elements relative to said side walls so that said shoulder elements define a box interior with said bottom, side and end walls when said box is disposed in said passageway, said shoulder element positioning means comprising reciprocating members and drive means for substantially simultaneously reciprocatably moving said members between a first position whereat said reciprocating members initially engage said shoulder elements to a second position whereat said shoulder elements are bent substantially 90 degrees relative to said side walls;

securing flap positioning means adjacent to said skid means adapted to bend said securing flaps relative to said shoulder elements and to place said securing flaps into engagement with said end walls, said securing flap positioning means comprising rotatable cam members adapted to engage said securing flaps and urge said securing flaps into engagement with said end walls, said rotatable cam members additionally exerting a force on said box tending to move said box along said passageway; and holding means engageable with said box bottom wall for positively restraining said box against motion within said passageway during the bending of said shoulder elements and said securing flaps.

2. The apparatus of claim 1 wherein said holding means comprises at least one movable stop member movably mounted relative to said framework adapted to be selectively positioned in engagement with said bottom wall during bending of said shoulder elements and said securing flaps.

3. The apparatus of claim 2 wherein said holding means comprises a plurality of reciprocatably movable stop members.

* * * * *